US005330192A

United States Patent [19]

Amos

[11] Patent Number: 5,330,192

[45] Date of Patent: Jul. 19, 1994

[54] ADJUSTABLE GOLF SWING PRACTICE DEVICE

[76] Inventor: James Amos, P.O. Box 2625, Muncie, Ind. 47307

[21] Appl. No.: 72,006

[22] Filed: Jun. 7, 1993

[51] Int. Cl.[5] ..... A63B 69/36

[52] U.S. Cl. ..... 273/191 A; 248/157; 248/165; 248/175

[58] Field of Search ..... 273/191 R, 191 A, 19 B, 273/192, 186.1, 407

[56] References Cited

U.S. PATENT DOCUMENTS

| | | | |
|---|---|---|---|
| 1,567,530 | 12/1925 | MacNaughton et al. | 273/191 A |
| 3,730,531 | 5/1973 | Zega | 273/191 A |
| 3,744,799 | 7/1973 | Hightower | 273/191 A X |
| 4,593,909 | 6/1986 | Anselmo et al. | 273/188 R |
| 4,659,084 | 4/1987 | Vuick | 273/188 R X |
| 4,852,881 | 8/1989 | Bellagamba et al. | 273/191 A X |
| 5,072,942 | 12/1991 | Hurley | 273/191 A |

*Primary Examiner*—George J. Marlo
*Attorney, Agent, or Firm*—James Creighton Wray

[57] ABSTRACT

A golf trainer has a continuous hoop formed by curved angle iron circular segments which are interconnected with short angle iron connector segments. The major segments have forward-extending flanges which, when joined together, form one continuous forward edge. A plastic wear strip with a U shape is pressed over the continuous edge of the joined flanges to form a continuous plastic wear strip for guiding the shaft of a golf club. The hoop has four lugs which extend rearward, joining two anchor adjustments. A base rod has U-shaped feet formed at front and rear ends. A front end which terminates upwardly in a front loop is connected to a lower lug. A rear end of the base rod extends upwardly to a rear loop. A lower adjustment rod has a lower loop which connects to the rear loop. An upper adjustment rod has an upper loop which connects to an upper lug. Sliders connected to an upper end of the lower adjustment rod receive a lower end of the upper adjustment rod. A bolt with a hand knob is threaded into one of the sliders to secure the slider in a fixed position to the upper rod. The front loops hold the bottom of the hoop above the ground, and the adjustment rods fix the angle of the hoop. A golfer grooves his swing by standing in the hoop and guiding a heel area of his club shaft along the plastic wear strip at the front of the hoop.

7 Claims, 1 Drawing Sheet

ADJUSTABLE GOLF SWING PRACTICE DEVICE

BACKGROUND OF THE INVENTION

Accuracy of a golf swing is the most important feature in a game of golf. A good golf swing should locate an area of the club shot near the club head in a flat plane which is more or less sloped according to the height of the golfer.

Golf professionals spend a great deal of time teaching golfers to perfect a uniform swing in a plane.

Golf training devices have attempted to provide golf swing plane training, but the cumbersomeness and difficulty of using and transporting the devices has rendered them ineffective.

A need exists for a golf swing practice device which produces a flat planar swing at a precise angle of slope, and which is easy to use and to assemble and which, when assembled, is stable and smooth and forms an uninterrupted surface for movement of the golf club.

The present invention fulfills that need.

SUMMARY OF THE INVENTION

A golf trainer has a continuous hoop formed by curved angle iron circular segments which are interconnected with short angle iron connector segments. The major segments have forward-extending flanges which, when joined together, form one continuous forward edge. A plastic wear strip with a U shape is pressed over the continuous edge of the joined flanges to form a continuous plastic wear strip for guiding the shaft of a golf club. The hoop has four lugs which extend rearward, joining two anchor adjustments. An anchor is positioned on each side of the hoop. Each anchor has a base rod and upper and lower adjustment rods. A base wire rod has U-shaped feet formed at upper and lower ends, and a front end which terminates upwardly in a front tab connected to a lower lug on the hoop. A rear end of the base rod extends upwardly to a rear tab. A lower adjustment rod has a lower tab which connects to the rear tab, and an upper adjustment rod has an upper tab which connects to an upper lug on the hoop. Sliders connected to an upper end of the lower adjustment rod receive a lower end of the upper adjustment rod. A bolt with a hand knob is threaded into one of the sliders to secure the slider in a fixed position on the upper rod. The front tabs hold the bottom of the hoop above the ground, and the adjustment rods fix the angle of the hoop.

A preferred golf trainer has an 84" diameter hoop having six circular segments made of $\frac{1}{8}\times1\times1$ inch angle iron. The bases of the segments lay flat on a plane and flanges of the segments extend forward and upward from the bases. Angle iron interconnectors interconnect the segments. Each angle iron interconnector has a relatively short circular segment shape, and a flat wall underlying an end portion of the flat wall base of one of the major angle iron segments. A flange extends forward therefrom and extends partially along an outside of the flange of the principal segment. One end portion of the connector is welded to an end of an angle iron segment. Another end of the connector has openings for receiving fasteners which extend through complementary openings in opposite ends of the major angle iron segments for assembling the segments into a hoop by overlying ends of the major segments having the complementary holes with extended ends of the segment connectors, and inserting fasteners through the holes.

The segments are thereby joined by the connectors in a continuous hoop with uniform forward-extending flanges forming one continuous line on abutted forward-extending edges of the flanges. A continuous U-shaped plastic wear strip has a closed forward portion and an open rearward portion which is pressed over the edges of the flanges for covering the flanges with the smooth, slippery continuous plastic strip. Lugs are connected to the segments and extend rearward therefrom in a direction opposite to the flanges. An adjustable anchor extends rearward and downward from the flanges.

The preferred adjustable anchor has a first $\frac{5}{8}$" diameter wire rod which has a loop or connector at one end. The wire rod extends outward and downward to a foot formed by a U-shaped bend in the rod, extends rearward to a second foot comprising a U-shaped bend in the rod, and then extends upward and has a loop formed in the opposite end thereof. A lower adjustment wire has a loop formed in a lower end thereof. An upper adjustment wire a loop formed in the upper end thereof. First and second slides connect to an upper end of the lower adjustment wire rod. Loops extending therefrom for receiving a lower end of the upper adjustment rod. One of the slides has a threaded opening for receiving a bolt with a hand knob for turning the bolt into the threaded opening until an end of the bolt engages and secures the lower end portion of the upper adjustment wire rod. The lower loop of the lower wire adjustment rod is connected to the rear loop of the bottom wire rod, and the upper loop of the upper wire adjustment rod is connected to an upper lug on the hoop. The forward loop of the bottom wire rod is connected to a lower lug on the hoop for supporting a lower portion of the hoop above the ground, and for relatively sliding the adjustment rods and securing the adjustment rods to control an angle of slope of the continuous front edge of the hoop.

The wire rod loops are connected to the lugs with bolts extending through holes in the lugs and through the loops and nuts. The lower loop of the lower adjustment rod and the rear loop of the base rod are connected together with a bolt which extends through the loops and a nut.

These and further and other objects and features of the invention are apparent in the disclosure, which includes the above and ongoing written specification, with the claims and the drawings.

DETAILED DESCRIPTION OF THE DRAWINGS

Figure 2:
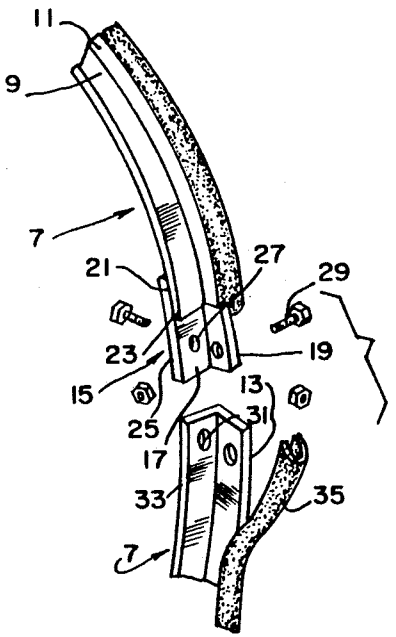
FIG. 2 is a detail of interconnection of hoop segments.
Figure 1:
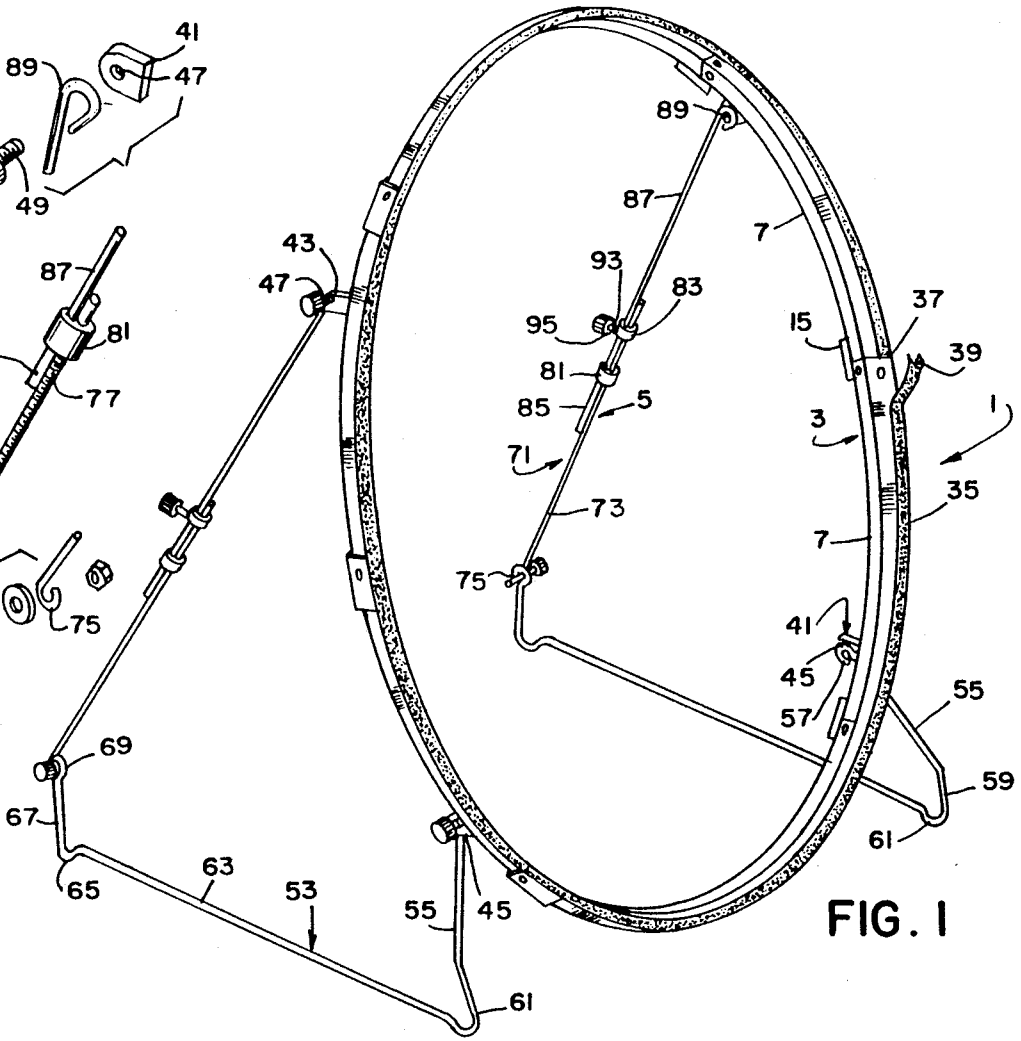
FIG. 1 is a perspective view of a preferred embodiment of the golf swing practice device of the present invention.
Figure 3:
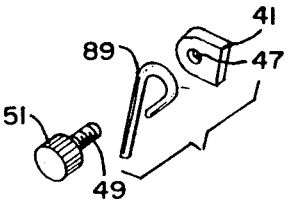
FIG. 3 is a detail of the preferred lug and anchor connections.
Figure 5:
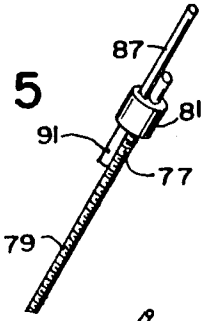
FIG. 5 is a detail of the adjustment rods.
Figure 4:
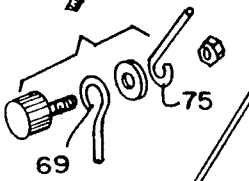
FIG. 4 is a detail of a preferred adjustment rod and support rod connection.

Referring to FIG. 1, a golf swing practice device is generally indicated by the numeral 1. The device includes a hoop 3 and anchor supports 5. The hoop 3 is made of six identical $\frac{1}{8}''\times1''\times1''$ angle sections which may be made of angle iron, aluminum or a rigid polymer. The sections are curved in the segment of a 42" radius circle. Each segment 7 has a base 9 which is flat and circular, and a rim or flange 11 which extends at right angles from the base 9 toward the front of the hoop, and which terminates in a frontal edge 13. The hoop segments 7 are interconnected by small segment-shaped connectors 15, which have flat bases 17 formed as circular segments with the same 42" radius circle, and flanges 19 which extend outward from the bases 17.

First ends 21 of the connectors 15 are welded to ends 23 of the major hoop segments 7 so that the flat surfaces 17 are rearward of the flat surfaces 9, and so that the flanges 19 are radially outward from the flanges 11 of the major hoop segments. The flanges 19 may be shorter than the flanges 11 so that the edge 13 of the major hoop segments 7 extends substantially forward of the forward edges of the flanges 19 of the connectors 15. Extended ends 25 of the flanges have openings 27 which receive bolts 29, which extend to complementary openings 31 in ends 33 of the hoop segments 7. When all of the segments are connected, a uniform hoop 3 is formed with continuous forward edges 13 of the flanges 11.

A slick polyvinylchloride or polypropylene U-shaped channel 35 in one continuous piece is slid over the edges 13 so that the U-shaped channel forms one continuous rounded slick surface at the forward edge of the hoop. Ends of the channel 37 and 39 are abutted.

To hold the hoop at the proper angles, two substantially parallel anchoring devices are used. Each anchoring device is made of three ⅜" diameter wire rods.

To attach the anchors 5, four lugs 41 are welded to each of four side segments 7 near respective upper and lower ends, forming upper lugs 43 and lower lugs 45. Each lug has a threaded opening 47 to receive a bolt 49 with a hand knob head 51.

The base rods 53 have a front portion 55, which extends downward from an upper loop 57 and which extends forward and then downward 59 to a front foot 61.

A long base rod 63 extends rearward to a rear foot 65, and then upward 67 to a rear loop 69. Rear adjustment rods 71 have a lower rod 73 with a lower loop 75, and an upper end portion 77 on which are marked or inscribed adjustment numbers 79. Slides 81 and 83 are connected to the lower rod by welding them to a lower rod, and the slides receive the lower end 85 of the upper rod 87, which terminates upwardly in a loop 89.

The lower end 91 of the upper adjustment rod 87 is aligned with an adjustment number 79 on the upper end of the lower rod, and a bolt 93 with a hand knob 95 is tightened in a threaded opening in the upper slide 83 to tightly engage the upper rod 87. Tightening bolts 93 on opposite supports 5 fixes the specific angle of the plane which is formed by the hoop 3. A person practicing his swing then grooves his swing by sliding the club shaft along the slick PVC plastic wear strip 35.

A golfer stands at point X with the club heel resting on the vinyl edge and follows the ring using a full swing to practice a perfect swing.

While the invention has been described with reference to specific embodiments, modifications and variations of the invention may be constructed without departing from the scope of the invention, which is defined in the following claims.

I claim:

1. A golf trainer comprises an 84" diameter hoop having six major circular segments made of angle iron, with bases and flanges, the bases of the segments lying flat and the flanges of the segments extending forward from the bases, plural angle iron connectors interconnecting the segments, each angle iron connector having a relatively short circular segment shape, and having a flat wall underlying an end of the flat wall of a major angle iron segment, and having a flange extending forward therefrom and extending partially along an outside of the flange of the major segment, one end portion of the connector being welded to one end of a major angle iron segment, and another end of the connector having openings for receiving fasteners extending through complementary openings in opposite ends of the major angle iron segments for assembling the segments into a hoop by abutting ends of the major segments and overlying ends of the major segments having the complementary holes with extended ends of the segment connectors, and fasteners extending through the holes and thereby joining the connectors and the major segments in a continuous hoop with uniform forward-extending flanges for forming one continuous line on forward-extending edges of the flanges, and a continuous U-shaped plastic wear strip having a closed forward portion and an open rearward portion connected to the flanges for covering the flanges with a smooth, continuous plastic strip, lugs connected to the segments and extending rearward therefrom in a direction opposite to the flanges, and adjustable anchors extending rearward and downward from the lugs.

2. The apparatus of claim 1, wherein the adjustable anchors comprises first and second base wire rods, each base rod having a front loop in one end thereof, and extending forward and downward to a foot formed by a U-shaped bend in the rod, and then extending rearward to a second foot comprising a U-shaped bend in the rod, and then each anchor extending upward and having a rear loop formed in the opposite end of the base rod, the lower adjustment rod having a lower loop formed in a lower end thereof, an upper adjustment rod having an upper loop formed in the upper end thereof, first and second slides connected to an upper end of the lower adjustment wire rod, the slides having receivers extending therefrom for receiving a lower end of the upper adjustment rod, one of the slides having a threaded opening therein for receiving a bolt with a hand knob for turning the bolt into the threaded opening until an end of the bolt engages and secures the lower end portion of the upper adjustment rod, the lower loop of the lower adjustment rod being connected to the rear loop of the base rod, and the upper loop of the upper wire adjustment rod being connected to an upper lug on the hoop, the forward loop of the base rod being connected to a lower lug on the hoop for supporting a lower portion of the hoop above the ground, and for relatively sliding the adjustment rods and securing the adjustment rods to control an angle of slope of the continuous front edge of the hoop.

3. The apparatus of claim 2, wherein the wire rod loops are connected to the lugs with bolts extending through holes in the lugs and through the loops and nuts, and wherein the lower loop of the lower adjustment rod and the rear loop of the base rod are connected together with a bolt which extends through the loops and a nut.

4. A golf trainer comprises a hoop having major circular segments made of curved angle material and including bases and flanges, with bases of the segments lying flat and flanges of the segments extending forward from the bases, angle interconnectors interconnecting the segments, each angle interconnector having a relatively short circular segment shape, and having a flat wall underlying the flat wall of the major angle segments, and having a flange extending forward therefrom and extending partially along an outside of a flange of an adjacent major segment, one end portion of each connector being welded to an end of an angle segment, and another end of each connector having openings for receiving fasteners extending through complementary openings in opposite ends of the major angle segments for assembling the segments into a hoop by overlying ends of the major segments having the complementary holes with the extended ends of the connectors and aligning the holes in the connectors with the complementary holes in the major segments, and fasteners extending through the aligned holes and thereby joining the connectors and the major segments in a continuous hoop with uniform forward-extending flanges for forming one continuous line on forward-extending edges of the flanges, and a smooth, slippery continuous U-shaped plastic wear strip having a closed forward portion and an open rearward portion connected to the flanges for covering the forward extending edges of the flanges with the smooth, continuous plastic strip, and further comprising lugs connected to at least some of the segments and extending rearward therefrom in a direction opposite to the flanges, and adjustable anchors extending rearward and downward from the lugs.

5. The apparatus of claim 4, wherein the adjustable anchors comprise first and second anchors, each anchor further comprising a base wire rod having a first end connection on a first thereof, the wire rod extending forward and downward to a first foot formed by a bend in the rod, and the rod then extending rearward to a second foot comprising a second bend in the rod, and then extending upward and having a second connection on a second end of the rod, a lower adjustment rod having a third connection on a lower end thereof, an upper adjustment rod having a fourth connection on an upper end thereof, first and second slides connected to an upper end of the lower adjustment rod, the slides having loops extending therefrom for receiving a lower end of an upper adjustment rod, one of the slides having a threaded opening therein for receiving a bolt with a hand knob for turning the bolt into the threaded opening until an end of the bolt engages and secures the lower end portion of the upper adjustment rod, the third connection of the lower adjustment rod being connected to the second connection of the base rod, and the fourth connection of the upper adjustment rod being connected to an upper lug on the hoop, the forward loop of the bottom wire rod being connected to a lower lug on the hoop for supporting a lower portion of the hoop above the ground, and for relatively sliding the adjustment rods and securing the adjustment rods to control an angle of slope of the continuous front edge of the hoop.

6. The apparatus of claim 5, wherein the connections are connected to the lugs with bolts extending through holes in the lugs and through holes in the connections and nuts, and wherein the third connection of the lower adjustment rod and the third connection of the base rod are Connected together with a bolt which extends through the holes in the connections and a nut.

7. The apparatus of claim 5, further comprising adjustment marks on at least one of the adjustment rods for aligning with the other rod for setting the slope of the hoop.

* * * * *